US011585185B2

(12) United States Patent
Radtke et al.

(10) Patent No.: US 11,585,185 B2
(45) Date of Patent: Feb. 21, 2023

(54) ISOLATION BARRIER

(71) Applicant: VERTICE OIL TOOLS INC., Stafford, TX (US)

(72) Inventors: Cameron Hill Radtke, Westhill (GB); William Luke McElligott, Westhill (GB); Philip Henry Turrell, Westhill (GB); Christopher Brian Kevin Cockrill, Westhill (GB)

(73) Assignee: VERTICE OIL TOOLS INC., Stafford, TX (US)

( * ) Notice: Subject to any disclaimer, the term of this patent is extended or adjusted under 35 U.S.C. 154(b) by 113 days.

(21) Appl. No.: 16/365,040

(22) Filed: Mar. 26, 2019

(65) Prior Publication Data

US 2019/0301264 A1 Oct. 3, 2019

(30) Foreign Application Priority Data

Mar. 30, 2018 (GB) ..... 1805341

(51) Int. Cl.
*E21B 33/127* (2006.01)
*E21B 17/042* (2006.01)

(52) U.S. Cl.
CPC ..... *E21B 33/1277* (2013.01); *E21B 17/042* (2013.01)

(58) Field of Classification Search
CPC ..... E21B 33/1277; E21B 17/042; F16L 1/00; F16L 55/16
USPC ..... 138/97, 98, 155
See application file for complete search history.

(56) References Cited

U.S. PATENT DOCUMENTS 7,306,033 B2 12/2007 Gorrara
2006/0090903 A1 5/2006 Gano et al.
2007/0167051 A1* 7/2007 Reynolds, Jr. ..... E21B 17/028 439/194

(Continued)

FOREIGN PATENT DOCUMENTS

EP 2570587 A1 3/2013
EP 2876251 A1 5/2015

(Continued)

OTHER PUBLICATIONS

Intellectual Property Office (UK), Combined Search and Examination Report for GB1805341.3; dated Aug. 24, 2018; entire document; Intellectual Property Office, South Wales, UK.

*Primary Examiner* — Blake Michener
*Assistant Examiner* — Yanick A Akaragwe
(74) *Attorney, Agent, or Firm* — Pierson IP, PLLC

(57) ABSTRACT

An assembly and method of manufacturing an assembly for use as an isolation barrier to be run in and secured within a well. The assembly has a sleeve member positioned on the exterior of a tubular body, fixed at each end to create a chamber therebetween. Fluid can enter the chamber through a port in the tubular body to morph the sleeve member against a larger diameter surface in the well. The sleeve member is formed of at least two materials, welded together and machined before being arranged on the tubular body. One material is more expandable than the other so as to morph more easily. The sleeve is connected to the tubular body by screw threads and seals. Initial construction of the sleeve member allows welding, inspection and machining without affecting the tensile strength of the tubular body or complete assembly.

9 Claims, 4 Drawing Sheets

(56) References Cited

U.S. PATENT DOCUMENTS

| | | | | |
|---|---|---|---|---|
| 2011/0266004 | A1* | 11/2011 | Hallundbaek ..... | E21B 33/1277 166/369 |
| 2012/0125619 | A1 | 5/2012 | Wood et al. | |
| 2012/0199339 | A1* | 8/2012 | Hallundbæk ..... | E21B 33/1277 166/134 |
| 2014/0196887 | A1* | 7/2014 | Hallundbæk ..... | E21B 33/1277 166/179 |
| 2016/0115761 | A1* | 4/2016 | Martin ..... | E21B 33/1212 166/387 |
| 2016/0222754 | A1 | 8/2016 | Hallundaek et al. | |
| 2016/0348463 | A1 | 12/2016 | Vasques et al. | |

FOREIGN PATENT DOCUMENTS

| | | | |
|---|---|---|---|
| GB | 2398312 | A | 8/2004 |
| WO | WO 2016/063048 | A1 | 4/2016 |
| WO | WO 2018/007483 | A1 | 1/2018 |

* cited by examiner

ISOLATION BARRIER

The present invention relates to an apparatus and method for securing a tubular within another tubular or borehole, creating a seal across an annulus in a well bore, centralising or anchoring tubing within a wellbore. In particular, though not exclusively, the invention relates to an assembly in which a sleeve is morphed to secure it to a well bore wall and create a seal between the sleeve and well bore wall to form an isolation barrier.

In the exploration and production of oil and gas wells, packers are typically used to isolate one section of a downhole annulus from another section of the downhole annulus. The annulus may be between tubular members, such as a liner, mandrel, production tubing and casing or between a tubular member, typically casing, and the wall of an open borehole. These packers are carried into the well on tubing and at the desired location, elastomeric seals are urged radially outwards or elastomeric bladders are inflated to cross the annulus and create a seal with the outer generally cylindrical structure i.e. another tubular member or the borehole wall. These elastomers have disadvantages, particularly when chemical injection techniques are used.

As a result, metal seals have been developed, where a tubular metal member is run in the well and at the desired location, an expander tool is run through the member. The expander tool typically has a forward cone with a body whose diameter is sized to the generally cylindrical structure so that the metal member is expanded to contact and seal against the cylindrical structure. These so-called expanded sleeves have an internal surface which, when expanded, is cylindrical and matches the profile of the expander tool. These sleeves work create seals between tubular members but can have problems in sealing against the irregular surface of an open borehole. The present applicants have developed a technology where a metal sleeve is forced radially outwardly by the use of fluid pressure acting directly on the sleeve. Sufficient hydraulic fluid pressure is applied to move the sleeve radially outwards and cause the sleeve to morph itself onto the generally cylindrical structure. The sleeve undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed sleeve. During the morphing process, both the inner and outer surfaces of the sleeve will take up the shape of the surface of the wall of the cylindrical structure. This morphed isolation barrier is therefore ideally suited for creating a seal against an irregular borehole wall.

Such a morphed isolation barrier is disclosed in U.S. Pat. No. 7,306,033, which is incorporated herein by reference. An application of the morphed isolation barrier for FRAC operations is disclosed in US2012/0125619, which is incorporated herein by reference.

Such isolation barriers are formed of a metal sleeve mounted around a supporting tubular body, and sealed at each end of the sleeve to create a chamber between the inner surface of the sleeve and the outer surface of the body. A port is arranged through the body so that fluid can be pumped into the chamber from the throughbore of the body. The increase in fluid pressure within the chamber causes radial expansion of the sleeve so that it is morphed onto the wall of the outer larger diameter structure which may be, for example, casing or open borehole.

To mount the sleeve upon the supporting tubular body requires a complicated arrangement of fittings to provide fixing and sealing of two cylindrical surfaces to each other. An arrangement is disclosed in US2012/0125619 in which an end nut is secured to the tubular body by suitable means. There is then provided a seal section housing which is screwed fast to the end nut and which surrounds a suitable arrangement of seals. The inner most ends of the respective seal section housings are secured to the respective ends of the sleeve by welding. A weld shroud is then provided co-axially about the outer surface of the weld, the respective end of the sleeve and the inner most end of the sealed section housing. The weld shroud is secured to the inner most end of the sealed section housing via a suitable screw threaded connection by welding. However, this arrangement is expensive and takes considerable time to assemble.

An alternative arrangement is disclosed in WO2016/063048 and is shown in FIG. 1, wherein the arrangement comprises a tubular body A having first and second tubular sections B and a central mandrel C each made of the same material. The tubular body A is further provided with sleeve member D formed of a different material from sections B and mandrel C. The sleeve member material is more ductile and thus more easily expandable than the material of the of tubular sections B and central mandrel C. The sleeve D is positioned on the exterior of the body A. Central mandrel C is secured to first and second tubular sections B using screw connections. Electron weld, or e-weld, connections E secure the sleeve member D between tubular sections B such that a chamber F is formed between central mandrel C and sleeve D. Port G is formed through the tubular body A and enables fluid pressure to be applied to the chamber F. The fluid pressure can be either be applied through application of an increase of pressure within the tubular applied from surface; or, fluid pressure can be applied from within the tubular by use of a hydraulic pressure delivery tool. The fluid pressure applied to the chamber causes the sleeve D to expand and move radially outward so that it is morphed onto the wall of the outer larger diameter structure which may be casing or borehole.

However, creating this sleeve assembly is a complicated process and, given the precision of the joints required, it is necessary to use electron beam welding to secure the sleeve to the tubular sections. By welding the sleeve in position once it is mounted upon the mandrel, the weld can cause damage to the mandrel by penetrating and weakening it. This is illustrated in FIG. 2 which shows a close up of an electron beam weld E between sleeve D and 30 tubular section B mounted on mandrel C. As can be seen, a first end of the weld E' extends into the body of mandrel C with approximately 50% of the thickness of the mandrel C weakened by the weld penetration E'. Even were the weld may not penetrate the mandrel, a region around the weld called the HAZ, or heat affected zone, will affect the properties of the mandrel.

Furthermore, once the assembly is welded together it becomes difficult to assess the quality of the joints without other parts of the assembly interfering in the x-ray or other assessment process. In addition, as the parts are all machined separately then assembled together, the machine tolerances must be set to a very high level of accuracy as a perfect fit together is essential making this a costly process.

It is therefore an object of at least one embodiment of the present invention to provide a morphed isolation barrier which obviates or mitigates one or more disadvantages of the prior art.

It is a further object of at least one embodiment of the present invention to provide a method of creating an isolation barrier in a well bore which obviates or mitigates one or more disadvantages of the prior art.

According to a first aspect of the present invention there is provided an assembly, comprising:

a tubular body arranged to be run in and secured within a larger diameter generally cylindrical structure;

a sleeve member, comprising a sleeve body, positioned on the exterior of the tubular body, to create a chamber therebetween;

the sleeve body being formed of at least a first sleeve material and a second sleeve material;

the sleeve member having first and second ends affixed and sealed to the tubular body;

the tubular body including a port to permit the flow of fluid into the chamber to cause the sleeve member to move outwardly and morph against an inner surface of the larger diameter structure; and characterised in that: the first sleeve material has different material properties from the second sleeve material and the first sleeve material and second sleeve material are joined together to form a continuous cylindrical sleeve body prior to being positioned on the tubular body.

Providing a sleeve body comprising of more than one material, with each material having different material properties, allows for the materials to be chosen so that the sleeve can deform in an efficient manner whilst maintaining structural strength and resilience. Preferably the sleeve materials are joined by welding. By welding the first and second materials together to form the sleeve body as a single continuous cylinder, this enables the single body to machined and inspected prior to being assembled on the tubular body. In addition, the welding together of the materials to form a single unit provides for the sleeve body to have variable performance abilities along it's length whilst maintaining the structure of a single unit.

Preferably, a central annular section of the sleeve body is formed of a first material. Preferably a first annular end section of the sleeve body and a second annular end section of the sleeve body are formed of a second material. Preferably, the central annular section of the sleeve body is disposed between the first and second annular end sections. The formation of the sleeve body having a central annular section of a first material and end annular sections of a second material enables the first and second materials to be chosen such that they behave in different manners along the length of the sleeve body.

Preferably, the first material has a higher degree of expandability or yield than the second material. Selecting a first material which is more expandable than the second material, the multi-material sleeve body can be formed such that it responds to fluid pressure in a manner which causes the morph against the inner surface of the large diameter structure to occur more swiftly and such that a more secure seal is formed.

Preferably, each material is a different type of material with the first material having at least one material property different from the second material. Alternatively each material may be a similar type of material with different material properties. By the first and second materials having different material properties, different sections of the body can perform in different ways. For example the first and second materials may be different grades of steel.

Further, the first and second materials may be the same material which is treated to produce different material properties. In this arrangement, the sleeve body may be formed of a single one-piece tubular section of a material wherein zones of the tubular member have different material properties. The different material properties may be achieved by heat treatment of one or more zones of the member. In an embodiment, one sleeve material is taken and different types of heat treatment are performed to the ends and the middle, so that you effectively have a sleeve with three zones, the two end zones (with one type of material property) and the middle zone with another type of material property. Advantageously, such a sleeve body would require no welding as the zones are joined together by virtue of them being from the same tubular section.

Preferably, the tubular body comprises one or more tubular sections arranged along a central longitudinal axis. The tubular body may comprise a first tubular section, a mandrel and a second tubular section.

Preferably, the first tubular section is connected to the first annular end section of the sleeve body by a screw thread.

Preferably, the second tubular section is connected to the second annular end section of the sleeve body by a screw thread.

Preferably, the mandrel is held between the first tubular section and the second tubular section to form the tubular body. Preferably also, there are one or more seals between the mandrel and the first and second tubular sections. More preferably, there are one or more seals between the mandrel and the first and second annular end sections of the sleeve body. The seals may be o-rings as are known in the art. In this way, the chamber is created between the mandrel and the sleeve body. Additionally, the sleeve member and the tubular body can be joined together without requiring welds.

The tubular sections and the mandrel may be formed of a single material. The single material may be a third material which has different material properties from at least one of the first and second materials. In this way, the tubular sections and mandrel can be manufactured in a stiff metal and the sleeve member made at least in part of a softer metal more suitable for morphing.

Preferably the sleeve member has a reduced outer diameter over a central portion thereof. In this way, the ends of the sleeve member can be thicker walled to increase the area for connection to the end members while providing a thin walled portion for ease of morphing.

The large diameter structure may be an open hole borehole, a borehole lined with a casing or liner string which may be cemented in place downhole, or may be a pipeline within which another smaller diameter tubular section requires to be secured or centralised.

Preferably the port includes a valve. More preferably, the valve is a one-way check valve. In this way, fluid is prevented from exiting the chamber between the sleeve member and the supporting tubular body following morphing to support the seal against the larger diameter structure.

Advantageously, the valve includes a ruptureable barrier device, such as a burst disk device or the like. Preferably the barrier device is set to rupture at a pressure for morphing to begin. In this way, fluids can be pumped down the tubing string into the well without fluids entering the sleeve until it is desirous to operate the sleeve.

The sleeve member may be provided with a deformable coating such as an elastomeric coating which may be configured as a single coating or multiple discreet bands.

According to a second aspect of the present invention there is provided a method of manufacturing an assembly for use as an isolation barrier, comprising the steps:

(a) assembling a sleeve member comprising a central portion formed of a first material and a first and second end portions formed of a second material with the first material having different material properties from the second material;

(b) welding the first end portion, central portion and second end portion together to form a sleeve body;

(c) machining the sleeve body to provide a uniform central bore;

(d) connecting a first tubular section to the first end portion via a screw threaded connection;

(e) sliding a mandrel inside the sleeve body and sealing the mandrel to the first tubular section, the first end portion and the second end portion;

(f) connecting a second tubular section to the second end portion via a screw threaded connection and sealing the mandrel to the second end portion, and the first and second tubular sections abut the mandrel to create a tubular body connectable in a work string and the mandrel includes a port through which fluid can flow to fill a sealed chamber between the mandrel and central portion.

By assembling the sleeve member in this way, the sleeve body may be formed of more than one material welded together to provide a sleeve member a single unit body with the ability for different areas of the body to respond differently to the application of fluid pressure. The method may include the step of inspecting the sleeve member prior to connecting to the tubular body. In this way, the integrity of the sleeve member can be assessed in isolation to any subsequent assembly in which it is included.

The method of manufacture may further include the step of:

(d) machining the sleeve body to reduce an outer diameter over a length of the central portion. In this way, the ends of the sleeve member can be thicker walled to increase the area for connection to the end members while providing a thin walled portion for ease of morphing.

The method of manufacture may further include the step of:

(e) machining the internal bore of a portion of the sleeve body ends to create a shoulder region having an annular end face. In this way, the ends of the sleeve member can be machined in preparation for co-operating with the tubular body member to create a connection.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 7:
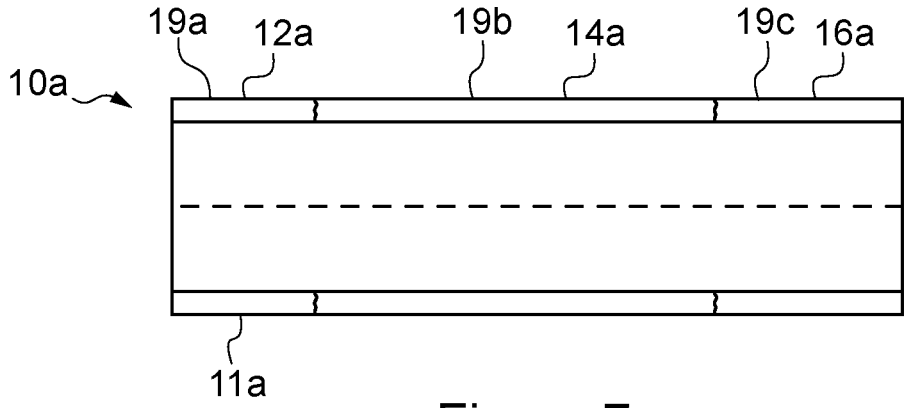
Figures 8A, 8B:
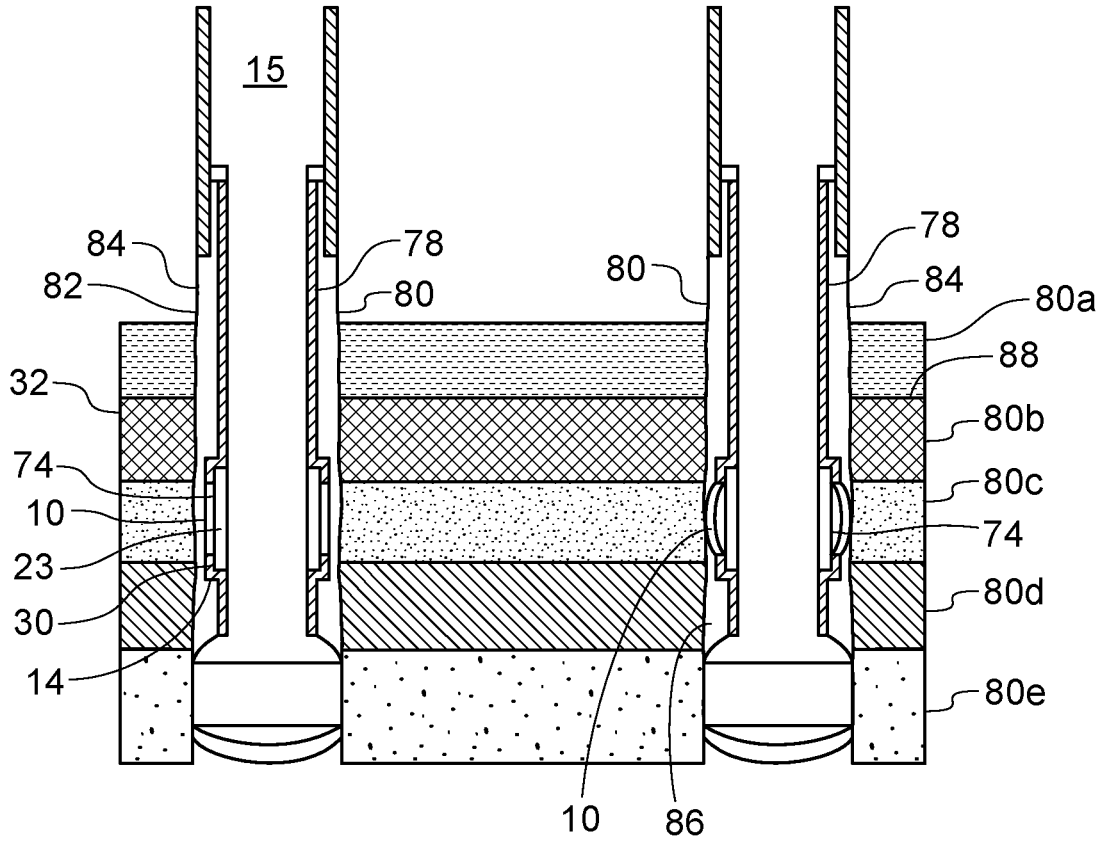

FIG. 7 is a cross-sectional view through a sleeve member assembly according to a still embodiment of the present invention; and FIGS. 8A and 8B are a schematic illustration of a sequence for setting a sleeve member in an open borehole of which: FIG. 8A is a cross-sectional view of a tubular string provided with an assembly according to the present invention and FIG. 8B is a cross-sectional view of the tubular string of FIG. 8A with a morphed sleeve, in use.

Figure 1:
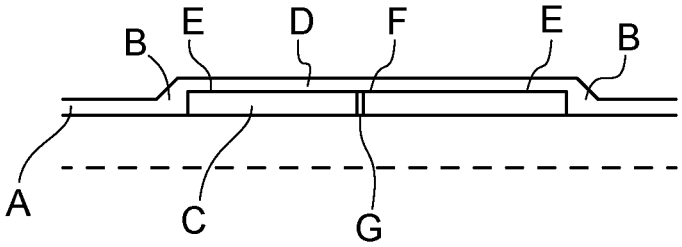
Figure 1 PRIOR ART
FIG. 1 is a cross-sectional view through an isolation barrier according to the prior art.
Figure 2:
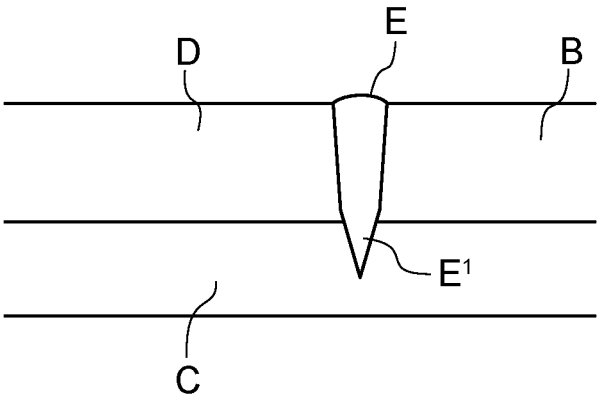
Figure 2 PRIOR ART
FIG. 2 is a part cross-sectional view through a detail of an assembly according to the prior art.
Figure 3:
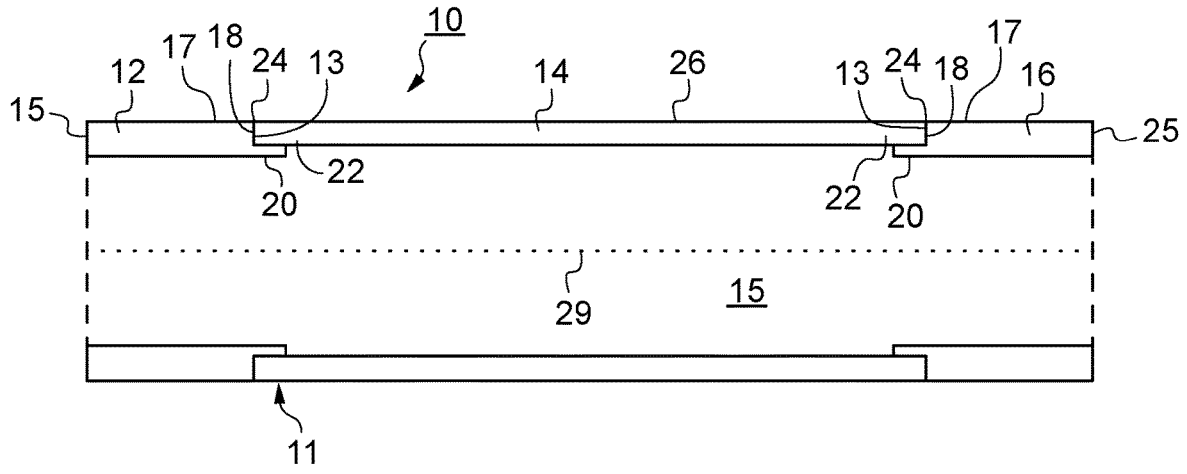
FIG. 3 is a cross-sectional view through a sleeve member assembly according to an embodiment of the present invention.

Reference is initially made to FIG. 3 of the drawings which illustrates a sleeve member assembly, generally indicated by reference numeral 10 according to an embodiment of the present invention. The sleeve member 10 includes a sleeve body 11 of tubular form comprising a first sleeve end 12, a central sleeve section 14 and a second sleeve end 16. In this embodiment, the first sleeve end 12 and the second sleeve end 14 are identical. The first sleeve end 12 and the second sleeve end 16 are formed of a first material. At a first end 17, each sleeve end 12,16 is provided with annular surface 18 around the circumference of sleeve end 12,16, with a shelf 20 projecting towards the central sleeve section 14. The central sleeve section 14 is formed of a second material and terminates at each end 22 in an annular face 13. The central sleeve section 14 has an initial side wall thickness marginally less than the initial sidewall thickness of the end sleeve sections 12, 16.

To assemble the sleeve body, end sleeve sections 12, 16 are brought together with the central section 14 such that each central section end 22 slides upon a shelf 20. Each central section end face 18 abuts against an annular face 13 of the sleeve end sections 12,16. A substantially even outer surface 26 is formed across the contiguous sleeve sections 12,14,16. Abutting annular faces 18 and 13 are then welded together, in this case by forming welded joints 24 to create a single sleeve member body 11 which is a continuous cylindrical unit.

By forming the sleeve body 11 of sections of different materials, in this case three different sections formed of two different materials, the expandable sleeve 10 can be constructed from material sections which have different material properties from one another. In this case, the first material, forming the central section 14, is formed typically from 316L or Alloy 28 grade steel but it could be any other suitable material which undergoes elastic and plastic deformation when pressure is applied to it. Ideally the first material exhibits high ductility, that is, high strain before failure and thus a higher degree of expandability than the second material. The second material, which forms the first and second end sleeve sections 12, 16 will be less ductile, higher gauge steel than the first material.

Selecting a first material which is more expandable than the second material, the multi material sleeve body can be formed such that it responds to fluid pressure in a manner which causes the morph against the inner surface of the large diameter structure to occur more swiftly and such that a more secure seal is formed. In welding the sections 12, 14,16 together as a unit, prior to the assembly of the sleeve member 10 on a tubular body, the sleeve member 10 can undergo quality control surveying and assessment, including x-ray of welds 24 without interference from other parts of a tubular assembly. At this stage of manufacture, the sleeve body 11 is rough machined unit in that it has not been assembled from components formed without machining without a high precision tolerance and as well as forming the sleeve body 11 quickly and efficiently.

Subsequently, the sleeve member 10 of FIG. 3 is machined, which can remove any welding imperfections as well as forming the sleeve body 11 in preparation for the tubular assembly.

Figure 4:
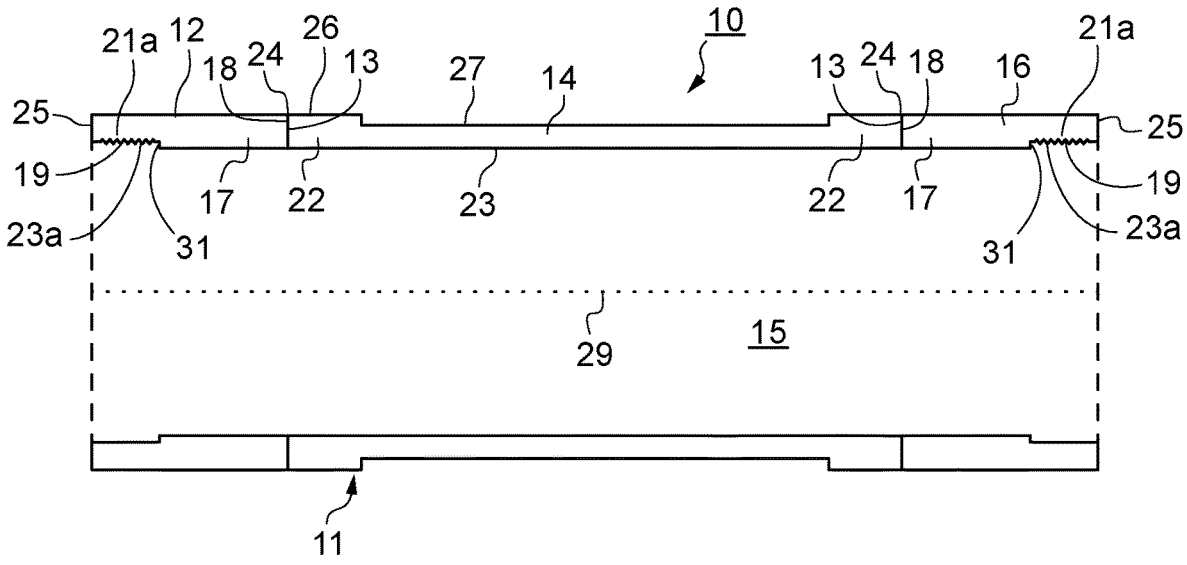
FIG. 4 is a cross-sectional view through a sleeve member assembly according to a further embodiment of the present invention.

An embodiment of a machined sleeve 10 is shown in FIG. 4 wherein the central section 14 has a recess 27 formed in the outer surface 26 such that the wall thickness is thinner in the recessed region 27 than along the remaining sleeve body 11. By removing thickness from the wall of the central section 14, the ability of the sleeve member 10 to expand across this section is increased. Thus, the thinner walled central portion 27 will, upon the application of fluid pressure, morph while the ends 12,16 are unaffected and remain principally in their original shape.

In addition, screw threads 21*a* are machined on the inner surface 23*a* of the recess 19 of the end sleeve sections 12, 16. Each end sleeve section 12, 16 terminates in an annular face 25 which is perpendicular to longitudinal axis 29. Recess 19 terminates in an annular face 31 which is also perpendicular to longitudinal axis 29.

Furthermore, the inner surface 23 of the sleeve member 10 has been machined to remove shelves 20 and provide an even surface 23 throughout the bore 15 including across the contiguous sections 12, 14 and 16.

The sleeve member 10 may be provided with a non-uniform outer surface 26 such as ribbed, grooved or other keyed surface (not shown) in order to increase the effectiveness of the seal created by the sleeve member 10 when secured within another casing section or borehole.

An elastomer or other deformable material (not shown) may be bonded to the outer surface 26 of the sleeve 10; this may be applied as a single coating but is preferably a multiple of bands with gaps therebetween. The elastomer bands or coating may have a profile or profiles machined into them. The elastomer bands may be spaced such that when the sleeve 10 is being morphed the elastomer bands will contact the inside surface of the larger diameter structure first. The sleeve member 10 will continue to expand outwards into the spaces between the elastomer bands, thereby causing a corrugated effect on the sleeve member 10. These corrugations provide a great advantage in that they increase the stiffness of the sleeve member 10 and increase its resistance to collapse forces.

Figure 5:
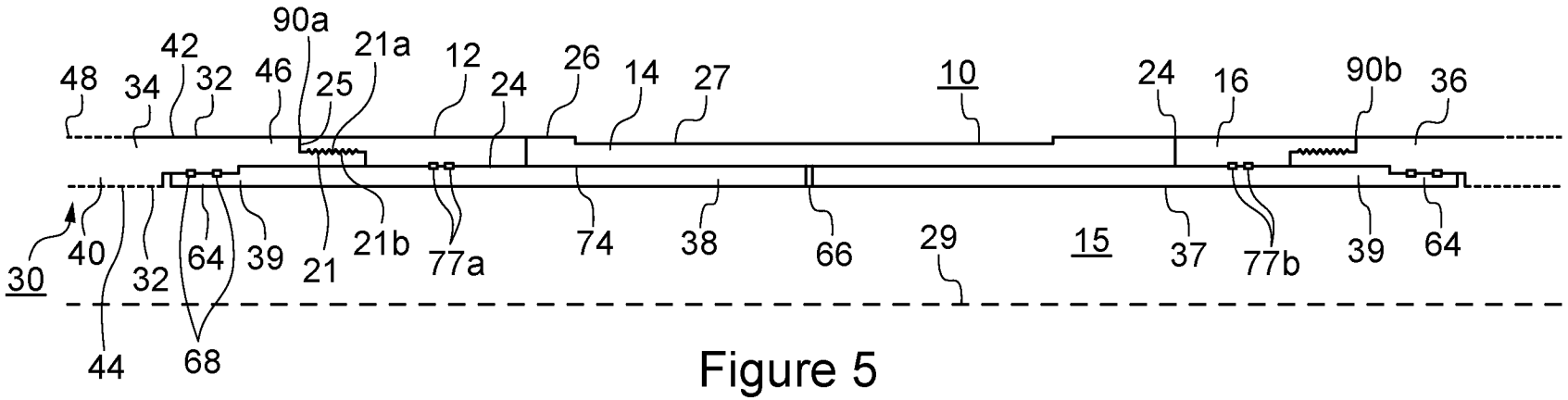
FIG. 5 is a part cross-sectional view through an assembly according to a yet further embodiment of the present invention.
Figure 6:
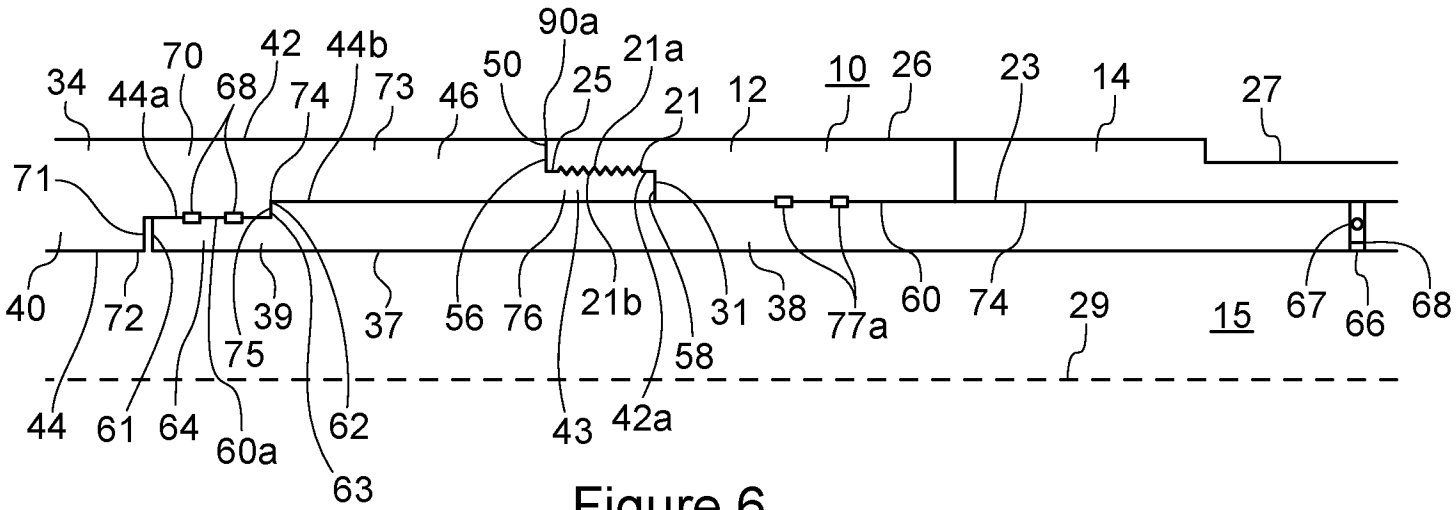
FIG. 6 is a part cross-sectional view through an assembly according to a still further embodiment of the present invention.

In FIG. 5, a portion of a cross section of a constructed assembly 30 according to an embodiment of the present invention is shown. The assembly 30 includes tubular body 32 comprising a first tubular section 34, a second tubular section 36, mandrel 38, and a sleeve member 10 as described with reference to FIGS. 3 and 4. A detail of the assembly 30 of FIG. 5 is shown in FIG. 6.

In this embodiment tubular sections 34, 36 are identical and each has a substantially cylindrical body 40 providing an outer surface 42 and an inner surface 44, a first end 46 and a second end 48. The second end 48 of first section 34 will have a traditional pin section (not shown) for connecting the body 32 into a string of pipe, casing or line. The second end 48 of second tubular section 36 will have a traditional box section (not shown) for connecting body 32 into a string of pipe, casing or liner. The mandrel 38, and first and second tubular sections 34, 36 may preferably formed of steel and, in particular, from a firmer and/or less ductile material than that used for either, or, both, of the first and second material of the sleeve 10.

A portion 70 of the first end 46 of sections 34, 36 has a side wall thickness less than the side wall thickness of the second end 48 of the sections 34, 36. A rim 72 formed circumferentially into the inner surface 44 of first end 46, defining an annular face 71 which is perpendicular to longitudinal axis 29, and providing portion 70 with recessed inner surface 44*a*.

A second portion 73 of the first end section 46 of sections 34, 36 is provided adjacent portion 70. The portion 73 has a side wall thickness less than the side wall thickness of the portion 70 with a rim 74 formed circumferentially into the inner surface 44*a* to provide recessed inner surface 44*b*. The rim 74 defines an annular face 75 which is perpendicular to longitudinal axis 29.

A third portion 76 of the first end section 46 of sections 34, 36 is provided adjacent portion 73. Portion 76 has a side wall thickness less than the side wall thickness of the portion 73 with a shoulder 50 recessed into the outer surface 42 of the first end 46 such that a shelf 43 is formed. Annular face 56 is defined which is perpendicular to longitudinal axis 29. Outer surface 42*a* of shelf 43 is provided with a screw thread 21*b*. The first end 46 terminates in an annular face 58 which is perpendicular to longitudinal axis 29 and presents a ring-faced planar surface.

The mandrel 38 is formed of mandrel body 37 provided with identical mandrel ends 39. Each end 39 of the mandrel 38 has a portion 64 recessed into outer surface 60 with side wall thickness at surface 60*a* of less than that of the adjacent mandrel body 37. A shoulder 62 is formed with annular face 63, which is perpendicular to longitudinal axis 29, defined circumferentially around the mandrel 38. Each end 39 of the mandrel 38 terminates in an annular face 61 which is perpendicular to longitudinal axis 29 and presents a ring-faced planar surface.

Sleeve member 10 is mounted co-axially upon mandrel 38. The inner diameter of the sleeve member 10 is just greater than the outer diameter at outer surface 60 of mandrel 38 so that it only has sufficient clearance to slide over the mandrel 38 during assembly. A chamber 74 is formed between the outer surface 60 of the mandrel 38 and the inner surface 23 of the sleeve member 10. First end seals 77*a* and second end seals 77*b* are disposed between the outer surface 60 of the mandrel 38 and the inner surface 23 of the sleeve member 10 and these define the longitudinal extent of the sealed chamber 74 formed between the mandrel 38 and the sleeve member 10.

When part of assembly 30, the first end 12 of the arrangement of sleeve member 10, and mandrel 38, are connected to the first tubular section 34. Annular face 75 of the first tubular section 34 abuts against annular face 63 of the mandrel 38. Portion 64 of mandrel 38 is received into recess inner surface 44*a* of first portion 70 of the first end 46 of first tubular section 34. Seals 68 provide a seal between the inner surface 44*a* of first portion 70 and outer surface 60*a* of mandrel portion 64.

In addition, screw thread 21*a* on sleeve end 12 co-operates with screw thread 21*b* on shelf 43 of first tubular section 36, with shelf 43 acting as a male coupling such that the sleeve 10 and first tubular section 34 screw together. Annular face 56 of the first end 46 of first tubular section 36 abuts against annular face 25 of the first end 12 of sleeve 10. Annular face 31 of sleeve 10 abuts against annular face 58 of first tubular section 36.

As the second material on the portion 12 will not yield under pressure in the chamber 74, screw thread 21 joint and seals 77*a* are sufficient to provide a pressure tight seal. In this way, no welding is required to the assembly 30 when made-up. If it is desired to provide a weld to secure sleeve 10 to first tubular section 34, abutting faces 56 and 25 can be welded together using, for example, an e-beam weld to create weld 90*a*. However, it will be noted that the faces 56 and 25 do not reach the mandrel body 37 and thus the presence of shelf 43 will prevent heat from the weld penetrating the mandrel and potentially affecting the strength of the mandrel 38 as for the prior art.

The same arrangement of interconnection, as described above, occurs between the second end 16 of sleeve 10, mandrel 38 and the second tubular section 36. The mandrel 38 is held without the requirement of screw threads or internal welds.

A port 66 is provided through the side wall of mandrel body 37 to provide a fluid passageway between the throughbore 15 and the outer surface 60 of the mandrel 38. The port 66 provides access to chamber 74. While only a single port 66 is shown, it will be appreciated that a set of ports may be provided. These ports 66 may be equidistantly spaced around the circumference of the mandrel body 37 and/or be arranged along the body mandrel body 37 between the first end seals 77*a* and the second end seals 77*b* which define the longitudinal extent of the chamber 74 formed between the mandrel 38 and the sleeve member 10.

At port 66 there is located a check valve 67. The check valve 67 is a one-way valve which only permits fluid to pass from the throughbore 15 into the chamber 74. The check valve 67 can be made to close when the sleeve member 10 has been morphed, which can be identified by a lack of flow through the annulus between the assembly 10 and the larger diameter structure. Closure can be effected by bleeding off the valve 67. Also arranged at the port 66 is a rupture disc 68. The rupture disc 68 is rated to a pressure below, but close to the morphed pressure value. In this way, the rupture disc 68 can be used to control when the setting of the sleeve 10 is to begin. The disc 68 can be operated by increasing pressure in the throughbore 15 towards a predetermined pressure value suitable for morphing the sleeve 10, but will prevent fluid exiting the throughbore 15 through the port 66 until this pressure value occurs.

The present invention means that the expandable sleeve 10 can be constructed from different materials, welded or otherwise joined together separately, and then machined into the final shape. This allows one to use a high expandable inner section and a less expandable outer section. The advantage of doing this separately, instead of welding it as part of the entire packer, is that the welds can be x-rayed or otherwise QA/QC without interference from the other parts, plus any welding imperfections can be machined away.

The resulting assembly 30 provides a packer or isolation barrier which has more controlled tensile strength of the packer. By performing the welding before the sleeve is slid onto the packer mandrel, the very real issue of either the weld penetrating into the mandrel and weakening it or the heat from the weld changing the properties of the mandrel steel (called the HAZ, or heat affected zone) and weakening it is eliminated. In the prior art, even though the mandrel may not be directly welded, it is negatively affected by the welds made adjacent to it.

FIG. 7 shows an alternative embodiment of a sleeve member, generally indicated by reference numeral 10*a*. Like parts to those of the previous Figures have the same reference numeral now suffixed 'a' to aid understanding. Sleeve member 10*a* includes a sleeve body 11*a* of tubular form. The sleeve body 11*a* is a unitary construction providing a one-piece sleeve member 10*a* with no welds. Thus the first sleeve end 12*a*, central sleeve section 14*a* and second sleeve end 16*a* are all joined together by virtue of them starting as being parts of the same tubular section. To provide the different material properties, zones 19*a,b,c* are treated so as to vary the material property of the sleeve body 11*a* over a localised area. Treatment may be by exposure to radiation, heating or cooling, dipping in chemical solutions, or any other action which will vary the material properties of the treated zone 19*a,b,c*. Zones 19*a,b,c* may be left untreated so that they retain their original material properties in contrast to treated zones. In this embodiment, zones 19*a* and 19*c* are treated. Thus the first sleeve end 12*a* and the second sleeve end 16*a* are both treated and will have identical material properties which are different from the material properties of zone 19*b*, being central sleeve section 14*a*. Accordingly, it is possible to take one sleeve material and perform different types of heat treatment to the ends and the middle, so that you effectively have a sleeve with three zones, the two end zones (with one type of material property) and the middle zone with another type of material property. The actual sleeve would be the same material, just with different properties in each zone depending what you properties are needed. There would be no welding involved on the sleeve body itself, but the sleeve body could be welded to the tubular body.

Reference will now be made to FIG. 8A of the drawings which provides an illustration of the method for setting a sleeve 10 within a well bore according to an embodiment of the present invention. Like parts to those in FIGS. 3 to 6 have been given the same reference numerals to aid clarity. In use, the assembly 30 is conveyed into the borehole by any suitable means, such as incorporating the assembly 30 into a casing or liner string 78 and running the string into the wellbore 82 until it reaches the location within the open borehole 80 at which operation of the assembly 30 is intended. This location is normally within the borehole at a position where the sleeve 10 is to be expanded in order to, for example, isolate the section of borehole 80*b* located above the sleeve 10 from that below 80*d* in order to provide an isolation barrier between the zones 80*b*, 80*d*. While only a single assembly 30 is shown on the string 78, further assemblies may be run on the same string 78 so that zonal isolation can be performed in a zone 80 in order that an injection, frac'ing or stimulation operation can be performed on the formation 80*a-e* located between two sleeves.

Each sleeve 10 can be set by increasing the pump pressure in the throughbore 15 to a predetermined value which represents a pressure of fluid at the port 66 being sufficient to morph the sleeve 10. This morphed pressure value will be calculated from knowledge of the diameter of the tubular body 32, the approximate diameter of the borehole 80 at the sleeve 10, the length of the sleeve 10 and the properties of the first and second sleeve materials and thickness of the sleeve 10. The morphed pressure value is the pressure sufficient to cause the sleeve 10 to move radially away from the body 32 by elastic expansion, contact the surface 84 of the borehole and morph to the surface 84 by plastic deformation primarily of the first material but to some extent also the second material.

When the morphed pressure value is applied at the port 66, the rupture disc 68 will have burst as it is set below the morphed pressure value. The check valve 67 is arranged to allow fluid from the throughbore 15 to enter the space, or chamber, 74 between the outer surface 60 of the mandrel 38 and the inner surface 23 of the sleeve member 10. This fluid will increase pressure in the chamber 74 and against the inner surface 23 of the sleeve 10 so as to cause the sleeve 10 to move radially away from the body 32 by elastic expansion, contact the surface 82 of the borehole and morph to the surface 82 by plastic deformation. When the morphing has been achieved, the check valve 67 will close and trap fluid at a pressure equal to the morphed pressure value within the chamber 74.

The sleeve 10 will have taken up a fixed shape under plastic deformation with an inner surface 23 matching the profile of the surface 82 of the borehole 80, and an outer surface also matching the profile of the surface 82 to provide a seal which effectively isolates the annulus 88 of the borehole 80 above the sleeve 10 from the annulus 86 below the sleeve 10. If two sleeves are set together then zonal isolation can be achieved for the annulus between the sleeves. At the same time the sleeves have effectively centred, secured and anchored the tubing string 78 to the borehole 80.

An alternative method of achieving morphing of the sleeve 10 may use a hydraulic fluid delivery tool. A detailed description of the operation of such a hydraulic fluid delivery tool is described in GB2398312 and with reference to the morphing of a sleeve to achieve a seal across a wellbore in WO2016/063048 and in particular with reference to FIG. 6B, the disclosures of which is incorporated herein by reference. The entire disclosures of GB2398312 and WO2016/063048 are incorporated herein by reference.

Using either pumping method, the increase in pressure of fluid directly against the sleeve 10 causes the sleeve 10 to move radially outwardly and seal against a portion of the inner circumference of the borehole 80. The pressure against the inner surface 23 of the sleeve 10 continues to increase such that the sleeve 10 initially experiences elastic expansion followed by plastic deformation. The sleeve 10 expands radially outwardly beyond its yield point, undergoing plastic deformation until the sleeve 10 morphs against the surface 82 of the borehole 80 as shown in FIG. 8B. If desired, the pressurised fluid within the space can be bled off following plastic deformation of the sleeve 10. Accordingly, the sleeve 10 has been plastically deformed and morphed by fluid pressure without any mechanical expansion means being required. When the morphing has been achieved, the check valve 67 can be made to close and trap fluid at a pressure equal to the morphed pressure value within the chamber 74.

The principle advantage of the present invention is that it provides an assembly for creating an isolation barrier in which the sleeve is formed of with zones having different material properties allowing controlled expansion along the length of the sleeve.

A further advantage of the present invention is that it provides an assembly for creating an isolation barrier in which no welding is required to the assembled barrier which would otherwise potentially weaken parts of the barrier. All welding can be completed on the sleeve independently which can be x-rayed and QA tested before being used in the assembly.

It will be apparent to those skilled in the art that modifications may be made to the invention herein described without departing from the scope thereof. For example, while a morphed pressure value is described this may be a pressure range rather than a single value to compensate for variations in the pressure applied at the sleeve in extended well bores and to take into account the different material behaviour of the first and second materials of the sleeve. The connection between the sleeve and end members can be by other means such as pressure connections and alternative welding techniques. The end faces need not be exactly perpendicular to the central longitudinal axis but may be tapered or of any profile which matches that of the opposing face. In addition, it will be noted that although the sleeve member was described as having a central portion of a first material and end portions of a second material, it will be appreciated that the sleeve may comprise a composite of sections each of which is formed of a material having a differing material property if desired. The formation of the sleeve member structure details the welding of the first and second materials together. It will be appreciated that any suitable joining process which connects the different materials to form a single continuously formed body may be used. This would include use of welding with or without application of heat and/or pressure and or a filler material, including any fusion, non-fusion or pressure welding technique as is determined to be appropriate.

We claim:

1. An assembly, for sealing and fixing to a well bore wall as an isolation barrier comprising:

a tubular body arranged to be run into the well on a work string and secured within a larger diameter generally cylindrical structure;

a sleeve member, positioned on the exterior of the tubular body, to create a chamber therebetween;

the tubular body including a port to permit the flow of fluid into the chamber to cause the sleeve member to move outwardly and morph against an inner surface of the larger diameter structure; and characterised in that:

the tubular body consists of a mandrel, a first tubular section for providing a connection to the work string at a first end of the assembly and a second tubular section for providing a connection to the work string at a second end of the assembly;

the sleeve member consisting of a sleeve body comprising a central annular section formed of a first sleeve material, disposed between a first annular end section and a second annular end section each formed of a second material;

the sections of the sleeve member being joined together end to end to form a continuous cylindrical sleeve body of uniform inner diameter prior to being positioned on the tubular body over a portion of the tubular body having an outer diameter matching the inner diameter of the sleeve body;

the first tubular section is connected to the first annular end section of the sleeve body by a screw thread, the second tubular section is connected to the second annular end section of the sleeve body by a screw thread and the mandrel is held between the first tubular section and the second tubular section to form the tubular body with seals located between the mandrel and the annular end sections and tubular sections so that no welding is required between the sleeve body and the tubular body;

the first sleeve material has a higher degree of expandability than the second sleeve material, so that on flow of fluid into the chamber, said sleeve member moves outwardly by plastic deformation primarily of the first material and to a lesser extent also the second material, to seal against said inner surface of the larger diameter structure.

2. The assembly according to claim 1 wherein the sleeve materials are joined by welding.

3. The assembly according to claim 1 wherein each sleeve material is a different type of material with the first sleeve material having at least one material property different from the second sleeve material.

4. The assembly according to claim 1 wherein each sleeve material is the same material with different material properties, the different material properties being created by treating a unitary sleeve body.

5. The assembly according to claim 1, wherein the tubular sections and the mandrel are formed of a single material.

6. The assembly according to claim 5 wherein the single material is a third material which has different material properties from at least one of the first and second sleeve materials.

7. The assembly according to claim 1 wherein the central annular section of the sleeve body has a reduced outer diameter over a central portion thereof.

8. The assembly according to claim 1 wherein the larger diameter generally cylindrical structure is selected from a group consisting of: an open hole borehole, a borehole lined with a casing or liner string which may be cemented in place downhole, or a pipeline within which another smaller diameter tubular section requires to be secured or centralised.

9. The assembly according to claim 1 wherein the port includes a valve.

* * * * *